US005125764A

United States Patent [19]

Veath, Sr.

[11] Patent Number: 5,125,764

[45] Date of Patent: Jun. 30, 1992

[54] VEHICLE FOR APPLYING AND SPREADING SURFACE COATING MATERIAL TO ROADWAY SURFACES

[76] Inventor: Clemons A. Veath, Sr., R.R. 1, Box 172B, Waterloo, Ill. 62290

[21] Appl. No.: 619,454

[22] Filed: Nov. 29, 1990

[51] Int. Cl.[5] ..... E01C 19/18; E02B 7/40; E02B 7/14

[52] U.S. Cl. ..... 404/108; 404/101; 404/112

[58] Field of Search ..... 404/101, 108, 110–112; 239/155, 156, 159–160, 162, 172, 101; 180/24.07, 212

[56] References Cited

U.S. PATENT DOCUMENTS

| | | | |
|---|---|---|---|
| 3,153,992 | 10/1964 | Dabelle | 404/111 |
| 3,199,423 | 8/1965 | Dickey | 239/159 X |
| 3,647,096 | 3/1972 | Holland | 404/111 X |
| 3,782,634 | 1/1974 | Herman | 239/156 |
| 3,784,100 | 1/1974 | Kirschmann | 239/156 X |
| 4,010,900 | 3/1977 | Flix et al. | 239/168 |
| 4,157,125 | 6/1979 | Bushell et al. | 180/212 |
| 4,311,274 | 1/1982 | Neal | 404/111 X |
| 4,477,203 | 10/1984 | Laditka | 404/111 |
| 4,569,296 | 2/1986 | Miller et al. | 239/159 X |
| 4,765,774 | 8/1988 | Wilson | 404/101 |
| 4,917,533 | 4/1990 | Wilson | 404/101 X |
| 4,958,955 | 9/1990 | Laditka | 404/111 X |

*Primary Examiner*—Ramon S. Britts
*Assistant Examiner*—Nancy P. Connolly
*Attorney, Agent, or Firm*—Rogers, Howell & Haferkamp

[57] ABSTRACT

A surface coating material applying and spreading apparatus comprises a forward and two rear drive wheels, with each of the three drive wheels being driven by a separate hydraulic motor independent of each other. A hydraulic circuit connects the three hydraulic motors of the drive wheels with a hydraulic pump, and communication between the pump and each of the motors is automatically controllable to drive one, two, or all three of the hydraulic motors and their associated drive wheels. The vehicle also comprises a spray bar assembly that is pivotally connected to a frame of the vehicle, and is pivoted to a raised and lowered position relative to the vehicle frame. The vehicle frame also releasably supports interchangeable rotating brush and wiper blade assemblies. The rotating brush assembly is universally pivotable horizontally and vertically from side to side, about the pivot connection to the vehicle frame. An engagement bar provided on the frame of the brush assembly enables simultaneous raising and lowering of both the brush assembly and the sprayer bar assembly. A separate lock on the frame of the sprayer bar assembly enables it to be locked in its raised position. The wiper blade assembly is also pivotally supported from the vehicle frame to be raised and lowered relative to the frame. The blade assembly comprises two pairs of wiper blades that are pivotally supported on a frame of the assembly. A mechanical linkage connecting the two pairs of blades enables each pair of blades to be pivoted relative to each other from side to side.

16 Claims, 10 Drawing Sheets

FIG. 3.
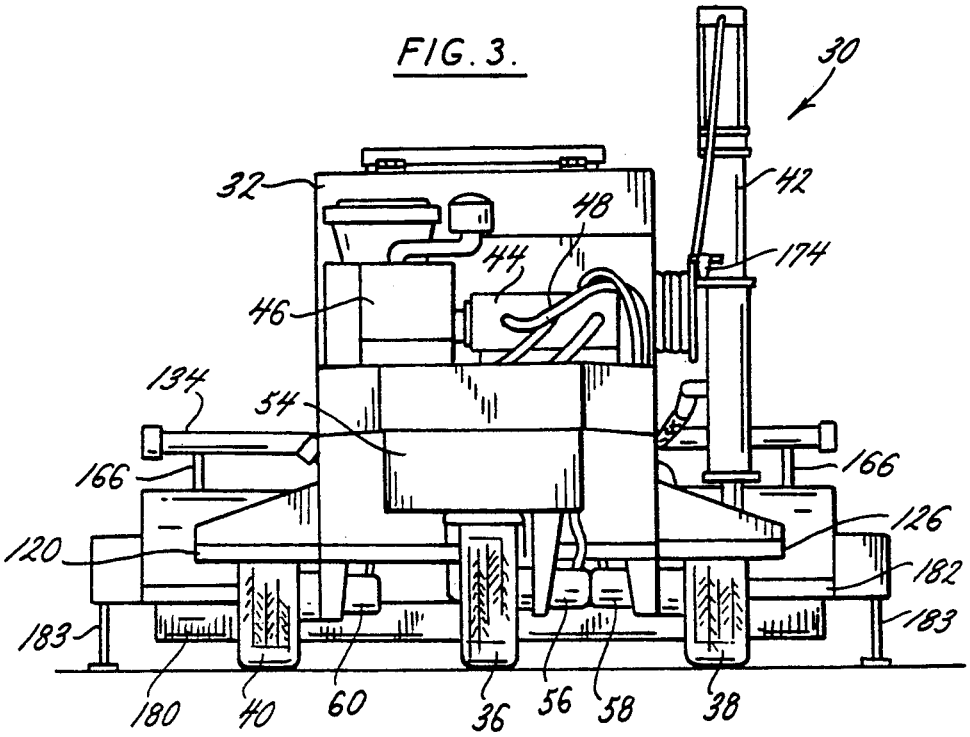
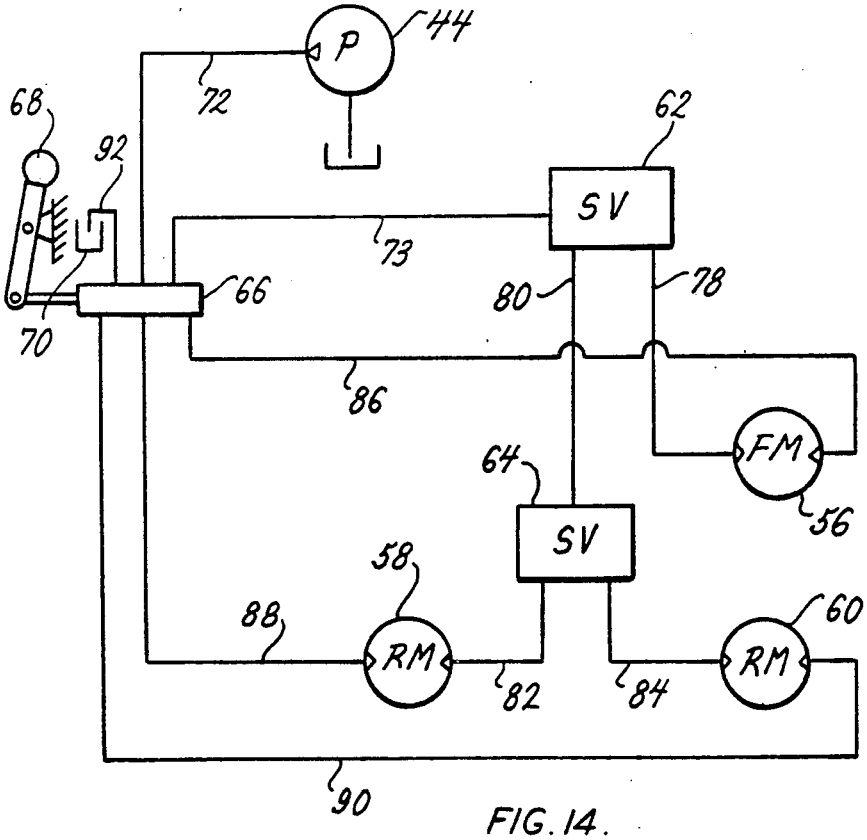
FIG. 14.

FIG. 7.
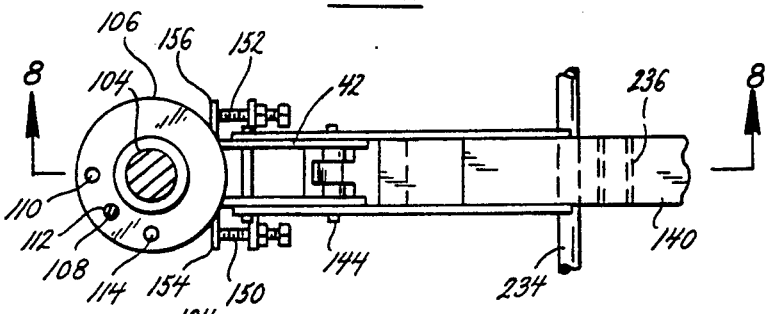
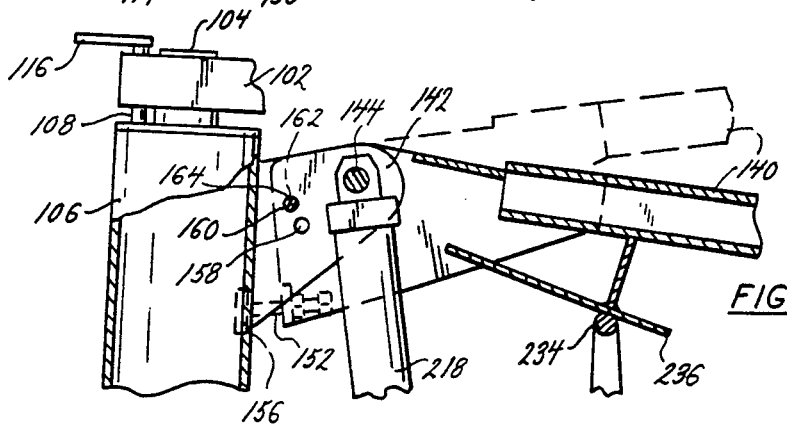
FIG. 8.
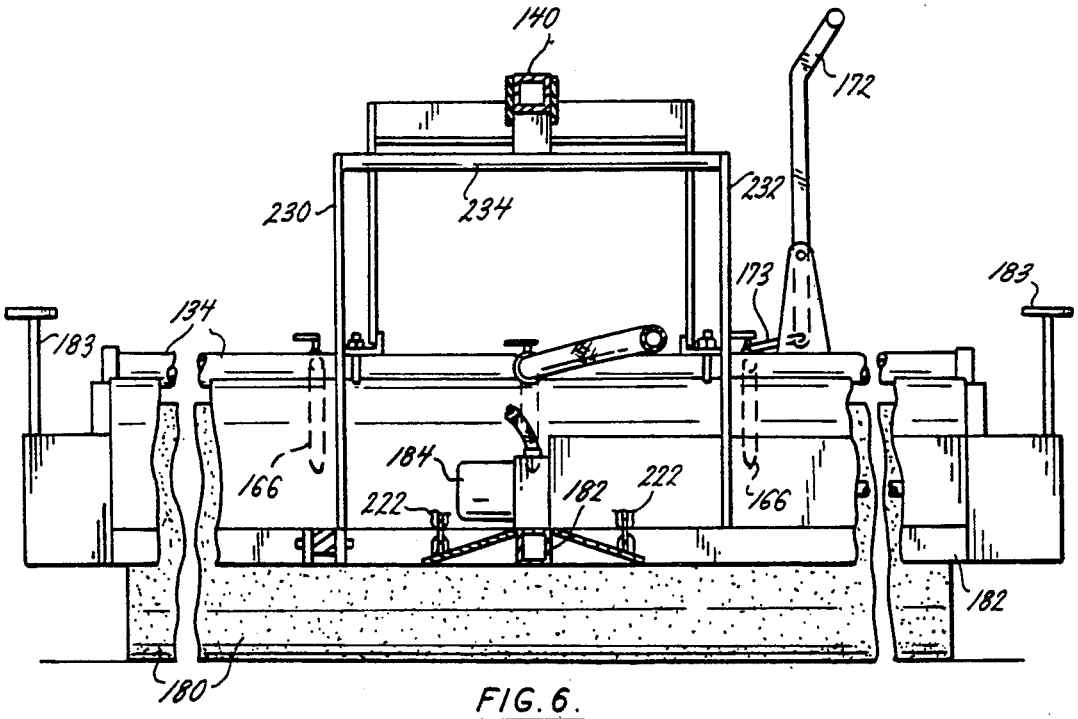
FIG. 6.

FIG. 18.
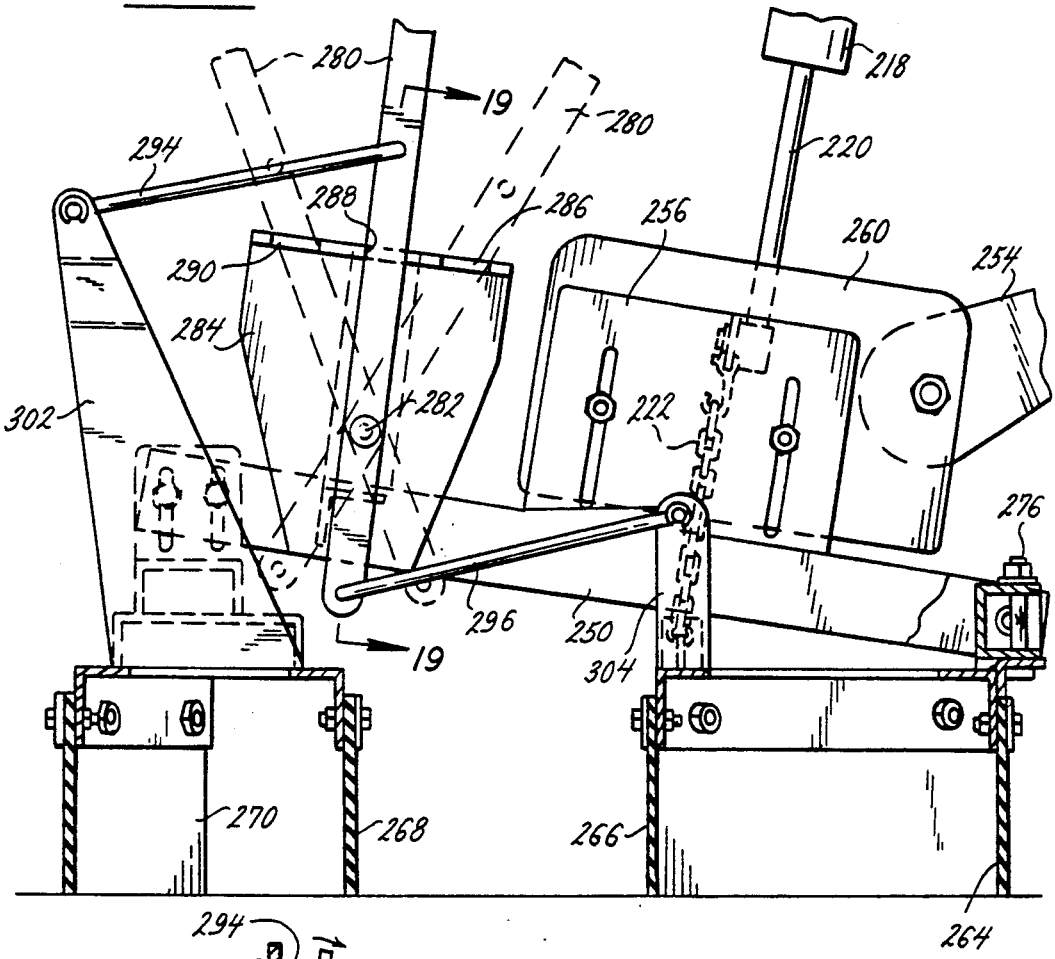
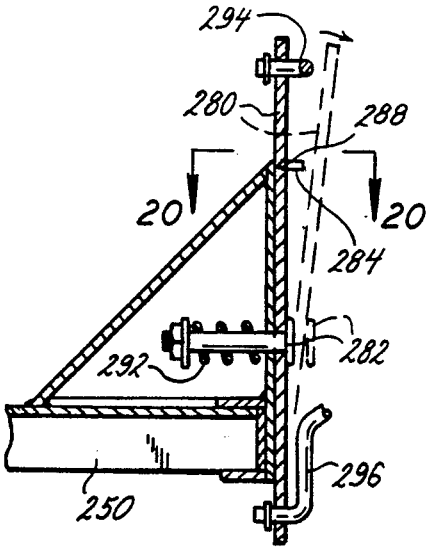
FIG. 19.
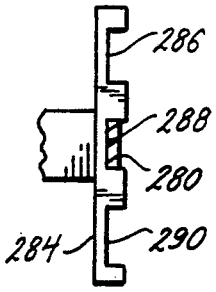
FIG. 20.

VEHICLE FOR APPLYING AND SPREADING SURFACE COATING MATERIAL TO ROADWAY SURFACES

BACKGROUND OF THE INVENTION

1. Field of the Invention

The present invention relates to a vehicle for applying and spreading surface coating material on roadway surfaces. In particular, the present invention pertains to a vehicle having a front and two rear drive wheels, where each of the wheels may be driven by the prime mover of the vehicle and power delivered to a slipping wheel will be automatically directed to wheels with traction. The vehicle also employs interchangeable rotating brush and pivoting wiper blade assemblies for spreading surface coating material, and a sprayer bar assembly for dispensing surface coating material to a roadway surface. The rotating brush and pivoting wiper assemblies are arranged to be selectively raised and lowered relative to the vehicle. The sprayer bar assembly is arranged to be selectively raised relative to the vehicle when the rotating brush is raised, and locked in its raised position with the rotating brush assembly being free to be raised and lowered.

2. Description of the Related Art

Roadway surfaces and traffic surfaces in general are exposed to the elements and the wear and tear of vehicle traffic, and in time deteriorate and need repair. Various types of machines have been developed which apply and spread surface coating material to traffic surfaces. Surface coating material has been applied to traffic surfaces in the past by vehicles or machines that dispense the materials by either spraying, brushing, and/or smoothing with a squeegee. While these prior art machines have been effective in applying the material to repair traffic surfaces, many prior art machines are disadvantaged in that they are designed to be used primarily on flat, horizontal surfaces.

Prior art machines often employ only a single drive wheel at the front of the vehicle. This single wheel makes it difficult to use the machine on an inclined surface as the single drive wheel located at the front of the vehicle will loose some of its tractive force and will often slip as it pulls the vehicle up the incline. With the front wheel being the only driven wheel in many prior art machines, this problem makes it very difficult to operate these machines on anything other than a horizontal road surface.

Prior art surface coating machines have also experienced problems in the methods employed in spreading surface coating materials over uneven road surfaces. For example, in surface coating machines employing squeegees or wipers, spreading the coating material before the wiper will tend to cause the material to accumulate to a deeper thickness in low spots in the uneven surface of the road. On road surfaces that have been purposely laid with a lateral incline to allow rain to run off to the side of the road, prior art machines operating on such roads often apply and spread a thicker accumulation of coating material at the outside or lower most edge of the laterally inclined road surface than at the inside or uppermost surface. Although spraying, brushing, and smoothing squeegee assemblies have been developed to provide a variety of means of applying surface coating material to inclined and uneven road surfaces, prior machines are often limited to use with only one or two of these application means, that being the sprayer with a brush or the sprayer with a squeegee. Where a brush or a squeegee may be effective in spreading surface coating material on certain road surfaces, they alone are not effective in spreading material efficiently over all road surfaces that would likely be encountered during the useful life of the machine.

It is an object of the present invention to overcome the disadvantages found in prior art surface coating machines by providing a vehicle for applying and spreading surface coating material on traffic surfaces having three drive wheels that are automatically operated, and that is adapted to apply and spread surface coating material to traffic surfaces by spraying, brushing and/or smoothing with a wiper assembly.

It is a further object of the present invention to provide a three wheeled vehicle for applying and spreading surface coating material, where each of the three wheels is automatically driven by a separate hydraulic motor associated with that wheel, wherein driving power is supplied to all three wheels simultaneously, or driving power is automatically diverted from a slipping wheel and is directed to wheels with traction to maintain constant the driving power delivered to the wheels with traction.

It is a further object of the present invention to provide a vehicle for applying and spreading surface coating material on traffic surfaces that employs a driven front wheel, and having an auxiliary water tank positioned over and forward of the wheel to enhance the traction of that wheel when driving up inclined surfaces.

It is a further object of the present invention to provide a vehicle for applying and spreading surface coating material on traffic surfaces that employs a spray bar assembly for depositing surface coating materials on the surfaces, and also employs interchangeable rotating brush and pivoting wiper assemblies.

It is a further object of the present invention to provide a vehicle for applying and spreading surface coating material on traffic surfaces that alternately employs a rotating brush and pivoting wiper assembly that are both arranged to be selectively pivoted laterally from side to side about a vertical axis, and vertically up and down about a horizontal axis.

It is a further object of the present invention to provide a vehicle for applying and spreading surface coating material on traffic surfaces that employs a sprayer bar assembly and a rotating brush assembly that are arranged to be raised relative to the vehicle, and the sprayer bar assembly is capable of being locked in place to enable lowering and raising the brush assembly independent of the sprayer bar assembly.

SUMMARY OF THE INVENTION

The surface coating material applying and spreading vehicle of the present invention is generally comprised of a vehicle frame that supports a reservoir holding surface coating material and a water tank located at the front of the vehicle, the frame in turn being supported on three wheels. One of the three wheels is centered at the forward end of the vehicle frame, and the other two of the three wheels are provided on opposite sides of the rearward end of the vehicle frame. The vehicle frame also supports a prime mover, a hydraulic fluid pump driven by the prime mover, and an operator's seat that is pivotally mounted on the frame to enable the operator to swing laterally from side to side on the vehicle to view the path of vehicle travel along the side of the vehicle.

Each of the three wheels of the vehicle is a drive wheel, with each of the wheels being automatically driven by a separate hydraulic motor associated with each wheel. Each of the three motors is in turn connected by a hydraulic circuit to the hydraulic pump driven by the prime mover. A series of valves are employed in the hydraulic circuit of the vehicle to automatically control the level of power delivered to each of the three hydraulic motors by the hydraulic pump. A first valve of the hydraulic circuit serves as a means of proportionally supplying hydraulic fluid under pressure from the pump, equally to both of the two hydraulic motors driving the two rear wheels of the vehicle. A second valve of the hydraulic circuit serves as a means of controlling the proportion of hydraulic fluid pressure supplied by the pump to the hydraulic motor that drives the front wheel of the vehicle, and to the two hydraulic motors that drive the rear wheels of the vehicle. A third manually operated valve is also provided in the hydraulic circuit. The manual valve serves as a means of selectively controlling the forward and reverse direction of travel of the vehicle as well as the vehicle speed. By the hydraulic circuit described above, the power supplied by the pump is equally distributed to all three drive wheels of the vehicle and is automatically controlled to power all three wheels, and is automatically diverted from a slipping wheel or wheels and is supplied to the wheel or wheels with traction to maintain constant the driving power delivered to the wheels with traction.

To enhance the tractive force of the front drive wheel of the vehicle, an auxiliary water tank is supported on the vehicle frame above the front drive wheel and slightly ahead of the wheel. The weight of the water contained in the auxiliary tank enhances the tractive force of the front drive wheel, even when the vehicle of the invention is being driven up an inclined surface.

A fogger suspended below the vehicle frame is also supplied with water from the auxiliary tank. The fogger is positioned before surface coating material dispensers of the vehicle, and spreads water over a traffic surface to be paved to enhance the spreading of the material on the surface. The vehicle is also provided with a hand operated wand that is supplied with water under pressure from the auxiliary tank. The wand is employed in cleaning the vehicle by spraying pressurized water.

The vehicle employs two different means of applying surface coating materials to traffic surfaces. A series of three surface coating material dispensers are supported by the vehicle frame and are spatially arranged laterally across the rearward end of the vehicle. Two of the three dispensers communicate with a surface coating material pump that, in turn, communicates with the reservoir of surface coating material. A manually operable valve controls the communication of the pump with the two dispensers. The third dispenser is located at the center rear of the vehicle and is gravity fed from the material reservoir. The three dispensers dispense the surface coating material onto the traffic surface in front of the material spreading assemblies of the invention.

A sprayer bar assembly is also pivotally supported on the vehicle frame and is suspended by the frame in a position behind the material spreading assemblies of the invention. The sprayer bar may be selectively raised and locked in its raised position to position it away from the working area of the material spreading assemblies. The sprayer bar may also be lowered to its operative position just behind the spreading assemblies. The sprayer bar is provided with a series of five nozzles spatially arranged along the bar, which is positioned laterally relative to the vehicle. A manually operated linkage assembly interconnects each of the five nozzles and simultaneously controls the dispensing of surface coating material from each of the nozzles. As with the two dispensers in front of the spreading assemblies, the sprayer bar is supplied with surface coating material from the reservoir by the surface coating material pump. A manual valve controls the supply of surface coating material to the sprayer bar.

The surface coating material applying and spreading vehicle of the present invention also comprises two interchangeable means of spreading the surface coating material applied to a traffic surface.

A rotating brush assembly is arranged to be pivotally supported on the frame of the vehicle at the rearward end of the vehicle. A hydraulically operated piston and cylinder motor is connected between the vehicle frame and the rotating brush assembly. The hydraulic motor in turn is connected with the hydraulic pump of the vehicle, and the motor selectively raises or lowers the rotating brush assembly relative to the vehicle in response to actuation of a manual valve that controls the communication of the motor with the hydraulic pump. The rotating brush assembly supports a rotating cylindrical brush laterally across the rearward end of the vehicle. The rotating brush is selectively operated to rotate in first and second directions, and at varying speeds by a hydraulic motor powering the brush. The hydraulic motor of the brush assembly also communicates with the hydraulic pump of the vehicle, and the direction of rotation of the brush as well as the speed of rotation are controlled by a manual valve interconnected between the brush hydraulic motor and the hydraulic pump. An additional hydraulic motor is connected between the rotating brush assembly and the vehicle frame. This additional motor is also a piston and cylinder assembly that communicates with the hydraulic pump of the vehicle. A manually operated valve is interconnected between this piston and cylinder motor and the hydraulic pump. Selective actuation of the manual valve causes the hydraulic motor to pivot the rotating brush assembly from side to side about a vertical axis extending through the pivot connection of the brush assembly and the vehicle frame. The rotating brush assembly also supports a horizontal engagement bar above the rotating brush. The horizontal bar is positioned to engage with the sprayer bar assembly, and cause the sprayer bar to raise in response to the rotating brush assembly being raised. From the raised position, the sprayer bar can also be lowered by lowering the rotating brush assembly, or can be locked in its raised position so that the rotating brush assembly may be lowered independent of the sprayer bar assembly. The rotating brush assembly, when attached to the vehicle frame, is positioned between the three surface coating material dispensers and the five spray nozzles of the sprayer bar assembly.

A wiper blade assembly is provided to be used interchangeably with the rotating brush assembly. The wiper blade assembly is pivotally connected to the vehicle frame at the rearward end of the vehicle, and the hydraulic motor that is connected between the rotating brush assembly and the vehicle frame is also connected between the wiper blade assembly and the vehicle frame. The hydraulic motor, as with the rotating brush assembly, is selectively operated by a manual valve that controls fluid communication between the hydraulic motor and the hydraulic pump of the vehicle. Selective operation of the manual valve causes the hydraulic motor to raise and lower the wiper blade assembly relative to the vehicle frame. The wiper assembly itself is comprised of two pairs of dual wipers that are pivotally mounted on a frame of the assembly. The pivoting connection of the dual wiper blades to the assembly frame enables each pair of wiper blades to pivot from side to side about a vertical axis. A manually operated linkage interconnects the two pairs of dual blades. By manipulating the manual linkage, the operator of the vehicle may pivot the left side of the dual wipers toward each other while pivoting the right side of the wipers away from each other, or may pivot the right side of the wipers toward each other while pivoting the left side of the wipers away from each other, or may pivot the pairs of dual wipers to extend parallel to each other laterally across the back of the vehicle. The rearward most wiper of each pair of dual wipers of the wiper blade assembly are also specially configured to catch surface coating material that is spread out over the ends of the front most wiper blade of each pair, and redirect the surface coating material back toward the middle of the rearward most wiper of each pair. The wiper blade assembly is interchanged with the rotating brush assembly of the invention to provide the most efficient means of spreading surface coating material for the particular traffic surface to be covered with surface coating material by the invention.

BRIEF DESCRIPTION OF THE DRAWINGS

Further objects and features of the present invention are revealed in the following detailed description of the preferred embodiment of the invention and in the drawing Figures wherein:

FIG. 3 is a front elevation view of the vehicle of the present invention;

FIG. 6 is a segmented elevation view, partially in section, of the rotating brush assembly of the invention taken along the line 6—6 of FIG. 4;

FIG. 7 is a segmented plan view, partially in section, of the pivoting seat mount and pivot connection of the rotating brush assembly to the vehicle frame taken along the line 7—7 of FIG. 4;

FIG. 8 is a segmented elevation view, partially in section, of the pivot connection between the rotating brush assembly and the vehicle frame taken along the line 8—8 of FIG. 7;

FIG. 14 is a schematic diagram of the hydraulic circuit that supplies the driving power to the three wheels of the vehicle;

FIG. 18 is a segmented side elevation view of the wiper blade assembly taken along the line 18—18 of FIG. 17;

FIG. 19 is a segmented view of the manual adjustment linkage of the wiper blade assembly taken along the line 19—19 of FIG. 18;

FIG. 20 is a plan view of the three position detent rack used in adjusting the orientation of the wiper blade assembly, taken along the line 20—20 of FIG. 19;

DESCRIPTION OF THE PREFERRED EMBODIMENT

Figure 1:
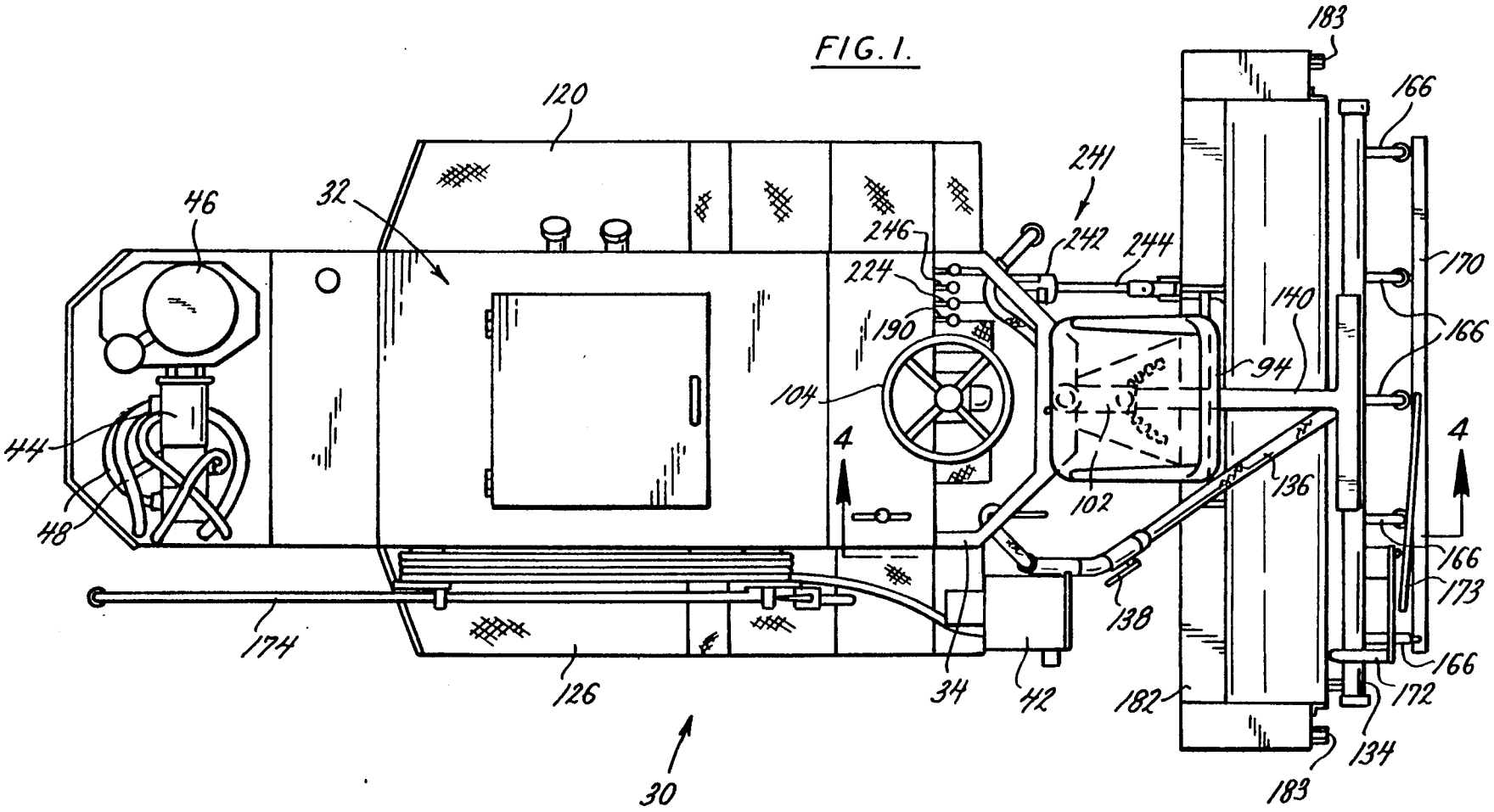
FIG. 1 is a plan view of the surface coating material applying and spreading vehicle of the present invention.
Figures 2, 9, 10, 11, 12:
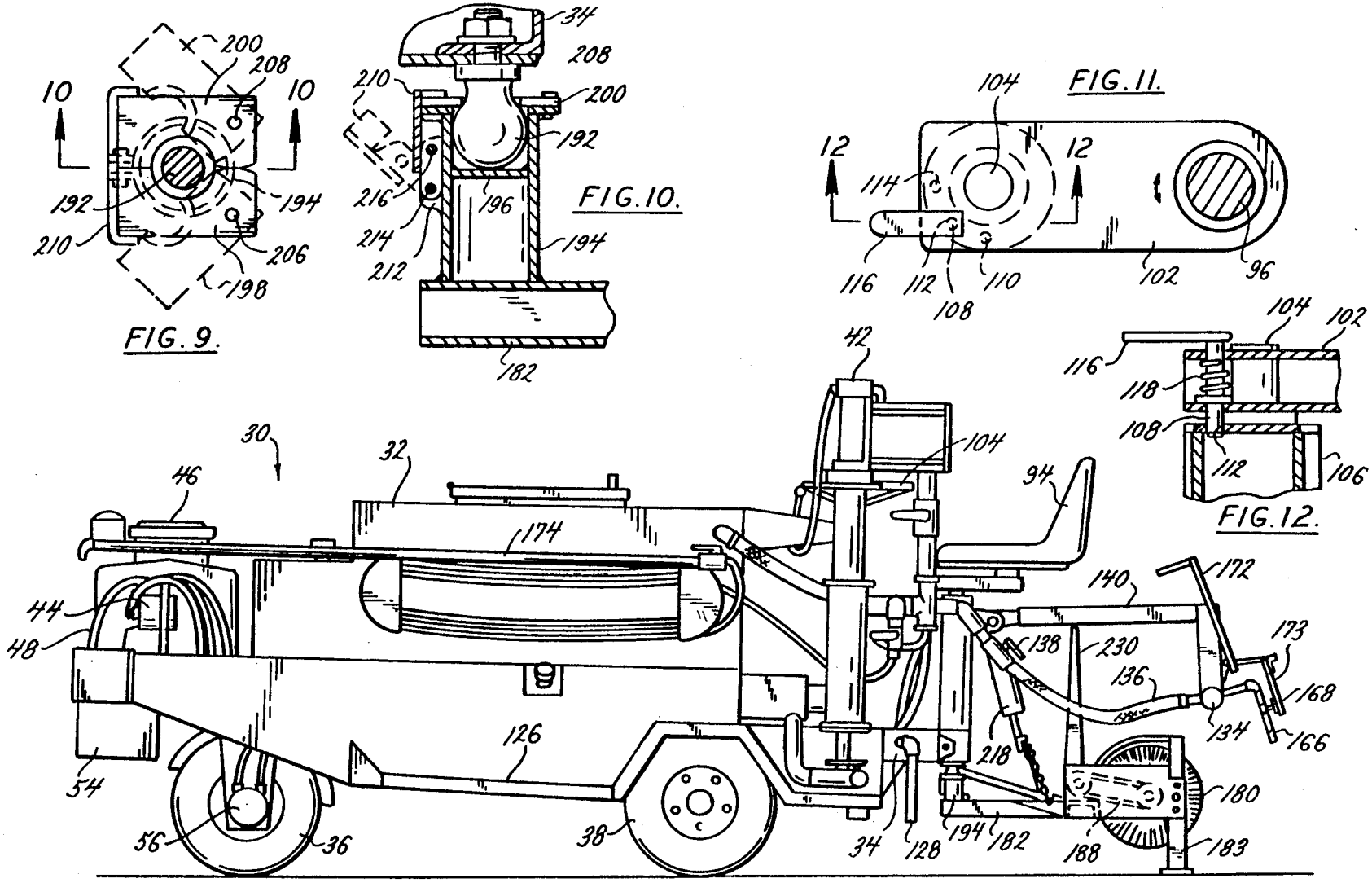
FIG. 2 is a side elevation view of the vehicle of the present invention.
FIG. 9 is a plan view in section of the pivoting connection supporting the rotating brush assembly from the vehicle frame taken along the line 9—9 of FIG. 4.
FIG. 10 is a segmented elevation view, partially in section, of the pivot connection between the rotating brush assembly and the vehicle frame taken along the line 10—10 of FIG. 9.
FIG. 11 is a plan view in section of the pivoting seat support taken along the line 11—11 of FIG. 4.
FIG. 12 is a segmented view, partially in section, of the locking pin assembly of the pivoting seat taken along the line 12—12 of FIG. 11.

The surface coating material applying and spreading vehicle 30 of the present invention is shown in FIGS. 1 and 2. The vehicle of the present invention comprises a reservoir 32 that houses both the supply of surface coating material carried by the vehicle, and a supply of water. The reservoir is connected with a vehicle frame 34, that in turn is supported on three wheels 36, 38, 40. The surface coating material stored in the reservoir is supplied to the material dispensing assemblies of the vehicle by a pump 42. A hydraulic pump 44 is provided at the forward end of the vehicle. The hydraulic pump is driven by a prime mover 46, either a diesel or gas engine, and supplies hydraulic fluid under pressure to the hydraulic circuit of the vehicle. The hydraulic fluid pressure is employed to drive the vehicle and to operate the surface coating material applying and spreading assemblies of the vehicle in a manner to be explained. The high pressure hydraulic fluid delivered by the hydraulic pump is routed to the various motors operated by the pressurized fluid through a series of high pressure hoses 48 that make up a part of the hydraulic circuit of the vehicle of the invention.

The vehicle is also provided with an auxiliary water tank 54 supported on the vehicle frame at a forward end of the vehicle. Positioning the auxiliary water tank 54 forward of the front drive wheel 36 applies a large portion of the weight of the water contained by the tank to the front drive wheel and, thereby, increases the tractive force of this drive wheel. The auxiliary tank is connected with a manual sprayer (not shown) that may be used to clean the vehicle after a surface coating operation. The auxiliary water tank is also drainable into the main water tank contained in the vehicle reservoir 32.

Each of the three wheels supporting the vehicle are drive wheels. Each of the three wheels has a hydraulic motor associated with the wheel, and each of the wheels is driven by operation of its associated hydraulic motor. The front wheel 36 of the vehicle is driven by a first hydraulic motor 56, and the left and right rear wheels 38, 40 of the vehicle are driven by second and third hydraulic motors 58, 60. A schematic diagram of the hydraulic fluid circuit that supplies pressurized hydraulic fluid to the three hydraulic motors and drives the motors and their associated drive wheels is shown in FIG. 14. This circuit includes the hydraulic pump 44, a first proportioning or splitter valve 62, a second proportioning or splitter valve 64, a third manually operated valve 66, and the front and two rear hydraulic motors 56, 58, 60. The manual valve 66 is controlled by manipulation of a manual lever 68 mounted to the vehicle and mechanically linked with the valve.

In operation in the forward drive direction, the hydraulic fluid pump 44 draws hydraulic fluid from a reservoir of fluid 70 contained in the reservoir 32 of the vehicle, and supplies this fluid under pressure to the supply conduit 72. The pressurized hydraulic fluid flows through the supply conduit 72 to the manual valve 66. The manual valve, having been manipulated to the forward drive position, directs the fluid through the first conduit 73 to the first proportioning valve 62. The first proportioning valve is set up to split the hydraulic fluid supplied to it, and supply the fluid to the second and third conduits 78, 80, with one-third of the total pressurized hydraulic fluid supplied to the first valve 62 being delivered to the first hydraulic motor 56, and two-thirds of the total pressurized hydraulic fluid supplied to the valve being delivered to the second proportioning valve 64 through the third conduit 80. The second proportioning valve 64 splits the pressurized hydraulic fluid supplied to it through the third conduit 80, and delivers this fluid to the fourth and fifth conduits 82, 84 in equal proportions. The pressurized hydraulic fluid travels through the fourth and fifth conduits 82, 84 and is delivered to the second and third hydraulic motors respectively. By employing the first and second proportioning valves 62, 64 in the hydraulic circuit described above, it can be seen that one-third of the total pressurized hydraulic fluid supplied to the circuit from the hydraulic pump 44 is routed to each of the first, second, and third hydraulic motors 56, 58, 60. A sixth fluid conduit 86 exits the first hydraulic motor 56 and routes hydraulic fluid to the manual operated valve 66. Seventh and eighth hydraulic conduits 88, 90 exit the second and third hydraulic motors 58, 60 respectively, and route hydraulic fluid to the manual valve 66. The manual valve 66, in turn, communicates with the fluid reservoir 70 through a ninth hydraulic conduit 92 to complete the hydraulic circuit. In order for the high pressure hydraulic fluid supplied by the hydraulic pump 44 to each of the respective first, second and third hydraulic motors 56, 58, 60 to drive the motors in a forward direction, the hydraulic fluid supplied to the motors must pass through the motors and return to the reservoir by way of the sixth, seventh, and eighth hydraulic fluid conduits 86, 88, 90, the manual valve 66, and the ninth hydraulic fluid conduit 92. The alternate communication between the sixth, seventh, and eighth hydraulic fluid conduits 86, 88, 90, and the supply conduit 72 or ninth fluid conduit 92 is controlled by the manual valve 66. When the manual valve 66 is manipulated to the forward drive position, it establishes fluid communication between the supply conduit 72 and the first fluid conduit 73, and it establishes fluid communication between the sixth, seventh, and eighth hydraulic fluid conduits 86, 88, 90 and the ninth fluid conduit 92. In this position of the manual valve, pressurized hydraulic fluid flows through the first, second and third hydraulic motors 56, 58, 60 and drives the motors. This in turn drives the front 36 and rear wheels 38, 40 of the vehicle.

In prior art hydraulic motor drives, should a wheel slip, the hydraulic motor turns faster due to the decrease tractive force on the wheel. The faster turning hydraulic motor driving the slipping wheel provides less resistance to fluid flow through the motor. This in turn causes an increased amount of pressurized fluid to be supplied to the motor of the slipping wheel than to other wheels with traction.

In the present invention, the two proportioning valves 62, 64 control the supply of pressurized fluid to the three motors so that should one or two of the three wheels driven by the motors slip, the proportioning valves maintain control of the proportion of pressurized fluid supplied to the three motors. The proportioning valves will still maintain control of the total pressurized fluid circulating through the circuit so that one third of the pressurized fluid is supplied to the first hydraulic motor 56 and one third of the total pressurized hydraulic fluid is supplied to each of the second and third hydraulic motors 58, 60. Providing the proportioning valves 62, 64 in the fluid circuit ensures that if one or two wheels of the vehicle slip, there will still be driving power supplied to one or two of the wheels with traction. Further movement of the manual valve lever 68 in the forward position increases the fluid flow through the valve 66 and in turn increases the speed of the motors 56, 58, 60 driving the vehicle wheels.

The manual valve 66 is also manipulated to reverse the flow of hydraulic fluid through the circuit and the valves and motors to reverse the direction of vehicle travel. In the reverse drive position of the manual valve 66, pressurized hydraulic fluid is supplied from the pump 44 through the supply conduit 72, the manual valve 66, the sixth fluid conduit 86, the first hydraulic motor 56, the second fluid conduit 78, the first proportioning valve 62, the first fluid conduit 73, the manual valve 66, and the ninth fluid conduit 92 to the fluid reservoir 70. This fluid circuit drives the first hydraulic motor 56 in a reversed direction. Fluid from the supply conduit 72 is also directed by the manual valve 66 to the seventh and eighth fluid conduits 88, 90, the second and third hydraulic motors 58, 60, the fourth and fifth fluid conduits 82, 84, the second proportioning valve 64, the third fluid conduit 80, the first proportioning valve 62, the first fluid conduit 72, the manual valve 66, and the ninth fluid conduit 92 to the fluid reservoir 70. This fluid circuit drives the second and third hydraulic motors 58, 60 in the reverse direction. The first and second proportioning valves 62, 64 work in the reverse direction in the same manner in which they do in the forward direction, proportioning one third of the total fluid pressure supplied through the circuit to each of the three hydraulic motors 56, 58, 60 and maintaining the fluid pressure supplied to the motors constant even if one or two of the vehicle wheels should slip. Just as in the forward drive direction, further movement of the manual valve lever 68 in the reversed position increases the fluid flow through the valve 66 and increases the speed of the motors 56, 58, 60 driving the vehicle in the reverse direction.

Figure 4:
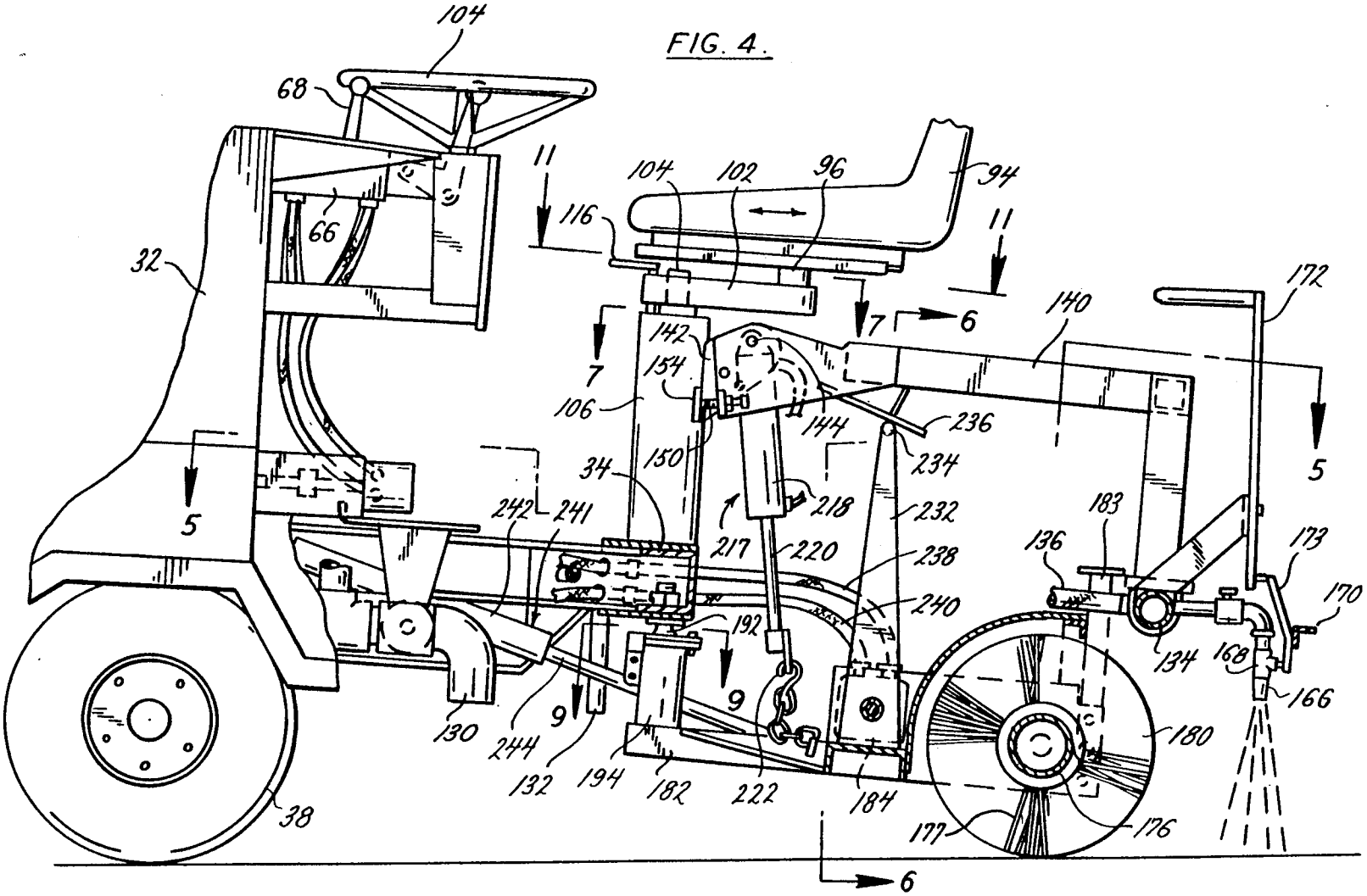
FIG. 4 is a segmented side elevation view, partially in section, of the vehicle supporting the rotating brush assembly of the invention.
Figure 5:
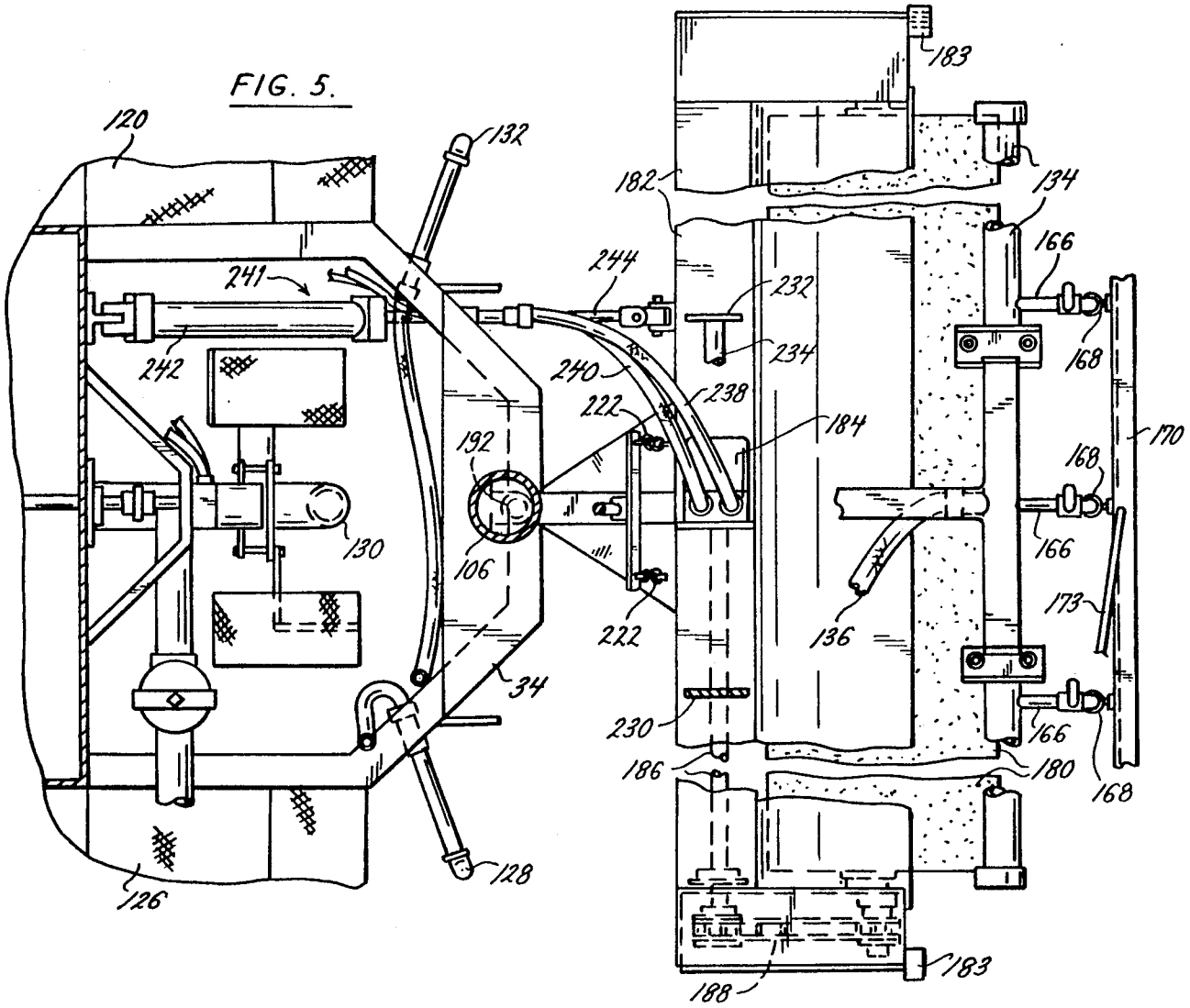
FIG. 5 is a segmented plan view taken along the line 5—5 of FIG. 4.

While operating the vehicle, the operator's seat pedestal enables the operator to move laterally from side to side to gain an unobstructed view of the surface coating path along the side of the vehicle. The construction of the operator's seat is best seen in FIGS. 4, 7, and 11. The operator's seat 94 is rotatably mounted on a pedestal 96 that in turn is mounted on the distal end of a cantilever arm 102. The operator seat 94 is also capable of being adjusted forward and backward on the pedestal 96 to adjust the position of the operator relative to the vehicle steering wheel 104. The opposite end of the cantilever arm 102 is pivotally supported on a pivot post 104 that is in turn secured to the top end of a vertical column 106 projecting upward from the vehicle frame 34. The cantilever arm 102 pivots about the pivot post 104. Provided in the cantilever arm 102 adjacent its connection to the pivot post 104 is a spring biased locking pin 108. A series of three holes 110, 112, 114 are provided in a top surface of the vertical column 106 and are dimensioned to receive the locking pin 108. In use, the operator pulls upward on a pin handle 116 against the bias of the locking pin spring 118 to disengage the locking pin 108 from the hole 112 in which it is engaged. With the pin 108 disengaged from the hole 112, the cantilever arm 102 is free to pivot about the pivot post 104 to swing the operator's seat 94 laterally out to the left or right sides of the vehicle. The locking pin handle 116 may then be released by the operator to cause the spring biased locking pin 108 to engage in one of the two outside holes 110, 114 to lock the operator seat in its adjusted position to the right side or the left side of the vehicle respectively. From the adjusted position of the seat to the right or left side of the vehicle, the operator may sight down the vehicle running boards 120, 126 respectively, to assist the operator in driving the vehicle in a straight path over the surface being coated. The running boards 120, 126 also provide a step for top loading the material tank of the vehicle. The seat 94 is also adjustable in forward and backward directions, enabling the operator to adjust his sitting position relative to the controls for the three drive wheels of the vehicle, the surface coating material dispensing controls, and the controls which operate the surface coating material applying and spreading assemblies of the vehicle.

The dispensing assemblies of the vehicle include three surface coating material dispensers 128, 130, 132 spatially arranged laterally across the vehicle. The three material dispensers are supported by the vehicle frame, and unlike prior art dispensers that are fed by gravity, two of the three dispensers are selectively supplied with surface coating material from the surface coating material pump 42. Selective operation of manual valves provided in the material supply conduit communicating the material pump 42 with the two dispensers 128, 132 supplies the surface coating material to the dispensers. Supplying surface coating material to the three dispensers 128, 130, 132 dispenses surface coating material on the traffic surface in front of the material spreading assemblies of the vehicle to be described later.

The material dispensing assemblies of the vehicle also include a sprayer bar assembly. The sprayer bar assembly includes a laterally disposed sprayer bar 134 that is supplied with surface coating material through a material conduit 136 connected between the sprayer bar and the material pump 42. The material conduit 136 is also provided with a manual valve 138 positioned intermediate the sprayer bar 134 and the material pump 42. The manual valve 138 controls the supply of surface coating material to the sprayer bar.

The sprayer bar 134 is pivotally supported on the vehicle frame by a sprayer bar frame 140. The sprayer bar frame 140 is pivotally connected to a bracket 142 secured to the vertical column 106 of the operator seat assembly by a pivot pin 144. The position in which the sprayer bar 134 is suspended over the traffic surface by the sprayer bar frame 140 is adjusted by a pair of threaded bolts 150, 152. The bolts are screw threaded through a portion of the sprayer bar frame adjacent the pivot pin 144, and abut against a pair of stop plates 154, 156 secured to the vertical column 106 of the operator seat assembly. By adjusting the extent to which the adjustment screws 150, 152 extend from the sprayer bar frame 140, the position of the sprayer bar 134 suspended above the traffic surface is adjusted. The sprayer bar frame support bracket 142 is also provided with a pair of holes 158, 160 adjacent the pivot pin 144. The pair of holes 158, 160 are positioned to line up with a hole 162 provided through the sprayer bar frame 140. The sprayer bar frame 140 is arranged so that one of the two pairs of holes 158, 160 in the sprayer bar bracket 142 will line up with the hole 162 in the sprayer bar frame 140 when the sprayer bar is in its raised and lowered positions respectively. With the position of the sprayer bar adjusted, a pin 164 is inserted through the aligned holes to lock the sprayer bar in its selected position suspended from the vehicle frame. With the two pairs of holes provided in the sprayer bar bracket, the sprayer bar may be locked by insertion of the pin 164 through the aligned holes of the frame and bracket in either a lowered or raised position relative to the vehicle frame.

The sprayer bar itself 134 extends laterally across the rearward end of the vehicle, and communicates with a series of five material dispensing nozzles 166 that are spatially arranged across the sprayer bar. Each of the nozzles is opened to dispense surface coating material through the nozzle by a valve assembly 168. Each of the valve assemblies 168 is connected to a control bar 170 that extends parallel to the sprayer bar 134. The control bar, in turn, is pivotally connected to a pivoting control arm 172 by a linkage member 173. By pivoting movement of the control bar 172, the operator of the vehicle is capable of simultaneously opening or closing each of the valve assemblies 168 of the sprayer bar dispenser nozzles 166. Operation of the sprayer bar assembly dispenses surface coating material behind the spreader assemblies of the vehicle.

A manually carried sprayer wand 174 is also supplied with surface coating material by the material pump 42. The wand 174 may be selectively operated to dispense surface coating material in areas that are difficult to reach using the vehicle 30.

Figure 13:
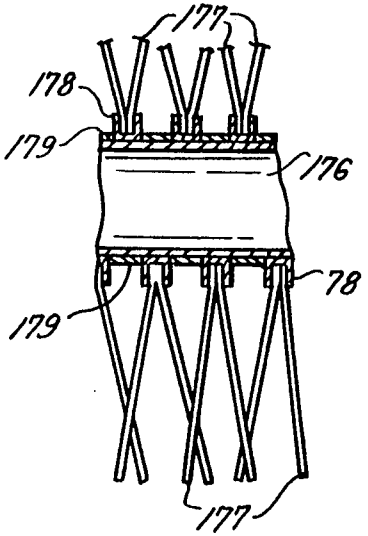
FIG. 13 is a segmented elevation view in section of the structure of the brush of the rotating brush assembly.

The first described of the surface coating material spreading assemblies of the vehicle is a rotating brush assembly. The rotating brush assembly includes a rotating brush 180 having a general cylindrical shape, and extending laterally across the rearward end of the vehicle. The detail of the brush is best seen in FIG. 13. The brush is constructed on a center shaft 176, and includes a plurality of bristles 177 secured in a length of U-shaped channel 178 that is spiraled over the shaft 176. A spacing strap 179 is also spiraled over the shaft surface and spacially disposes the spirals of the channel 178 over the shaft surface. The brush 180 is rotatably supported on a brush assembly frame 182, and is powered by a hydraulic motor 184. The frame includes a pair of pivoting supports 183 that are lowered to support the frame when transporting or storing the vehicle to prevent the brush from being crushed by the weight of the frame. The brush 180 is driven by the hydraulic motor 184 through a drive shaft 186, and a chain drive 188 connecting the brush 180 to the hydraulic motor 184. The hydraulic motor 184 is powered by pressurized hydraulic fluid supplied from the hydraulic pump 44. Selective actuation of a manual valve 190 on the dashboard of the vehicle controls the brush in a neutral condition, and a forward and reverse drive rotation, and also controls the forward and reverse rotational speeds.

The brush assembly frame 182 is suspended from a rearward end of the vehicle frame 34 by a ball and socket connection. The vehicle frame 34 has attached at its rearward end a ball 192 that extends downward from the vehicle frame. At the forward end of the brush assembly frame 182 there is provided a short tube 194 that extends upward from the frame. The interior dimensions of the tube 194 are just large enough to receive the ball 192 within the tube. A bottom plate 196 is provided inside the tube to limit the extent to which the ball 192 can extend into the tube interior. A pair of pivoting closing plates 198, 200 are pivotally connected at a top end of the tube 194 by pivot pins 206, 208. The closing plates 198, 200 have a semi-circular notch cut into their opposed edges. The notches are dimensioned to engage around the shank of the ball 192 when the ball is inserted into the tube 194 and the closing plates 198, 200 are closed around the shank. The position of the closing plates 198, 200 closed around the ball shank is shown in FIG. 9, along with the respective positions of the closing plates 198, 200 (shown in phantom lines) in their opened positions to allow insertion or removal of the ball 192 into or out of the tube 194 interior. A plate clamp 210 is pivotally mounted on a flange 212 on the side of the tube 194 by a pivot pin 214. With the closing plates 198, 200 closed around the shank of the ball 192 to hold the ball inside the interior of the tube 194, the plate clamp 210 is pivoted upward as viewed in FIG. 10, and engages around the opposite edges of the closing plates as best seen in FIG. 9. With the plate clamp 210 in this position, a pin 216 is inserted through a hole provided in the flange 212 and a hole in the plate clamp 210. The pivot pin holds the plate clamp securely in its position around the closing plates 198, 200, thereby establishing a releasable universal pivoting connection between the vehicle frame and the brush assembly frame that enables the brush assembly frame to pivot laterally from side to side relative to the vehicle frame, and to pivot horizontally up and down relative to the vehicle frame. This universally pivoting movement of the brush assembly frame 182 relative to the vehicle frame enables the rotating brush 180 to follow virtually any contour of the traffic surface being coated by the vehicle.

A hydraulic reciprocating motor 217 is also pivotally connected between the vehicle frame and the brush assembly frame. The hydraulic reciprocating motor is comprised of a cylinder 218 pivotally connected to the sprayer bar frame supporting bracket 142 at the pin 144, and a reciprocating piston rod 220 connected by adjustable length chain 222 to the brush assembly frame 182. Opposite sides of a piston (not shown) connected to the piston rod 220 and contained within the cylinder 218 are selectively communicated with pressurized hydraulic fluid or drained, to selectively raise and lower the brush assembly frame 182 relative to the vehicle frame 34. Communication between the cylinder 218 of the reciprocating hydraulic motor and the hydraulic fluid pump 44 is controlled by a manually operated lever 224 provided on the dashboard of the vehicle. Selective manipulation of the manual lever 224 supplies pressurized hydraulic fluid to the cylinder 218 of the reciprocating motor to extend the piston rod 220 from the motor and permit the brush assembly frame 182 to be lowered. This enables the rotating brush 180 to engage the traffic surface being coated. On alternate operation of the manual lever 224, pressurized hydraulic fluid is supplied to the opposite end of the cylinder 218 of the hydraulic motor, causing the piston rod 220 to be retracted into the cylinder. This causes the hydraulic motor to raise the brush assembly frame 182 from the traffic surface, thereby disengaging the rotating brush 180 from the surface.

The brush assembly frame 182 includes a pair of vertical supports 230, 232 that extend upward from the frame to a horizontal engagement bar 234. The horizontal engagement bar 234 is positioned to engage against an abutment bracket 236 secured at the bottom of the sprayer bar frame 140. The engagement between the abutment bracket 236 and the engagement bar 234 enables the brush assembly frame 182 to pivot the sprayer bar frame 140 upward about the pivot pin 144 when the brush assembly frame 182 is raised relative to the vehicle frame. The engagement between the brush assembly frame and the sprayer bar frame also permits the sprayer bar frame to be lowered when the brush assembly frame is lowered relative to the vehicle. Alternately, when the sprayer bar frame is raised relative to the vehicle frame by raising the brush assembly frame relative to the vehicle frame, the operator may then insert the locking pin 164 through the aligned holes in the support bracket 142 and the sprayer bar frame 140 to lock the sprayer bar frame in its raised position relative to the vehicle. With the sprayer bar frame so locked in its raised position, the operator may then selectively raise and lower the brush assembly frame 182 relative to the vehicle independent of the sprayer bar frame. In this manner, the operator of the vehicle may raise and lower both the sprayer bar frame and the brush assembly frame simultaneously relative to the vehicle frame, or may raise the sprayer bar frame and brush assembly frame relative to the vehicle frame, and lock the sprayer bar frame in its raised position to permit the selective lowering and raising of the brush assembly frame independent of the sprayer bar frame.

The brush assembly frame 182 is also completely removable from its supporting pivoting connection to the vehicle frame by disengaging the closing plates 198, 200 from their engagement around the ball shank 192, and disconnecting the hydraulic fluid pressure hoses 238, 240 that communicate the hydraulic motor 184 of the rotating brush 180 with the hydraulic circuit of the vehicle. Releasable connections are provided between the hoses 238, 240 and the hydraulic motor 184 to facilitate the quick disassembly of the rotating brush assembly from the vehicle frame. The connection between the reciprocating hydraulic motor and the brush assembly frame 182 is quickly disassembled by detaching a pair of hooks at the ends of the chain 222 connecting the brush assembly frame to the hydraulic motor.

A second reciprocating hydraulic motor 241 is also connected between the brush assembly and the vehicle frame. This second motor 241 provides the pivoting movement laterally from side to side of the brush assembly frame relative to the vehicle frame. This second hydraulic motor is also comprised of a cylinder 242 pivotally connected to the vehicle frame, and a reciprocating piston rod 244 connected to a piston slidably received in the cylinder at one end, and pivotally connected to the brush assembly frame 182 at its opposite end. This second hydraulic motor is also connected to the hydraulic pump 44 of the vehicle, and is selectively retracted and extended by manipulation of a manual lever 246 provided on the dashboard of the vehicle. By viewing FIG. 1, it can be seen that extending the piston rod 244 from the piston cylinder 242 will cause the brush assembly frame 182 to pivot about the ball 192 of the ball and socket connection to the left. Manipulating the manual lever 246 to control the piston rod 244 to be retracted into the piston cylinder 242 will cause the brush assembly frame 182 to pivot about the ball 192 of the ball and socket connection to the right as viewed in the drawing Figure. The connection between the second reciprocating hydraulic motor 241 and the brush assembly frame 182 is quickly disassembled to enable disassembly of the brush assembly from the vehicle frame by detaching the pivot connection of the piston rod 244 to the brush assembly frame 182.

Disassembly of the brush assembly from the frame 34 of the vehicle enables assembly of a wiper blade assembly to the vehicle frame. The wiper blade assembly is comprised of a frame 250 that is suspended from the vehicle frame 34 by a pair of pivot arms 252, 254 that are releasably and pivotally connected to the vehicle frame. The blade assembly frame 250 includes a pair of stationary plates 256, 258 that extend upward from a top surface of the frame. Each plate has a pair of slots that extend vertically through the plates. A pair of adjustment plates 260, 262 are adjustably connected to the stationary plates 256, 258 respectively by a pair of nut and bolt threaded fasteners that extend through holes (not shown) provided in the adjustment plates and the vertical slots in the stationary plates. The threaded fasteners releasably secure the two plates together in a desired adjusted position. The adjustment plates 260, 262 are in turn connected to the pivot arms 252, 254, respectively. By adjusting the connection between the stationary plates 256, 258 and the adjustment plates 260, 262, the orientation of the blade assembly frame 250 relative to the surface being coated may be adjusted.

The blade assembly frame 250 is also suspended from the vehicle frame 34 by the chains 222 of the first reciprocating hydraulic motor 217. This hydraulic motor is the same motor that is employed in raising and lowering the rotating brush assembly relative to the frame. Just as in connecting the rotating brush assembly to the hydraulic motor, one end of the chains 222 is connected to the frame 250 of the blade assembly, and the opposite end of the chains 222 is connected to the distal end of the piston rod 220 of the reciprocating hydraulic motor. Just as in the operation of the rotating brush assembly, alternate extension and retraction of the piston rod 220 into and out of the cylinder 218 of the hydraulic motor causes the blade assembly frame 250 to be raised and lowered about the pivoting connection between the pair of pivot arms 252, 254 and the vehicle frame 34.

Figure 21A:
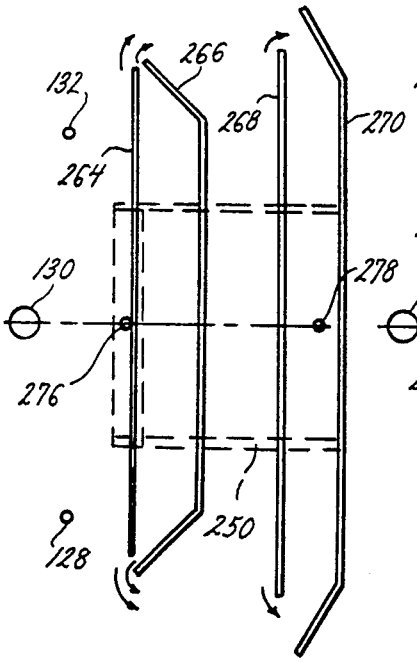
FIG. 21 is a schematic representation of three possible adjustment configurations of the pairs of dual wiper blades of the wiper blade assembly.
Figure 21B:
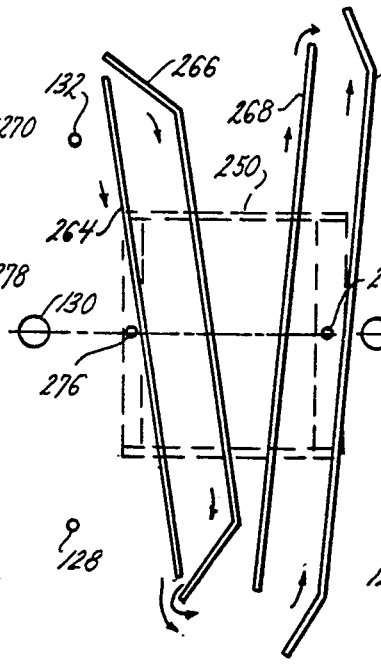
Figure 21C:
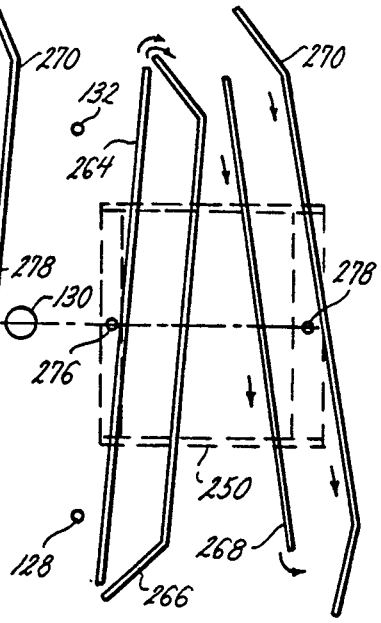
Figure 16:
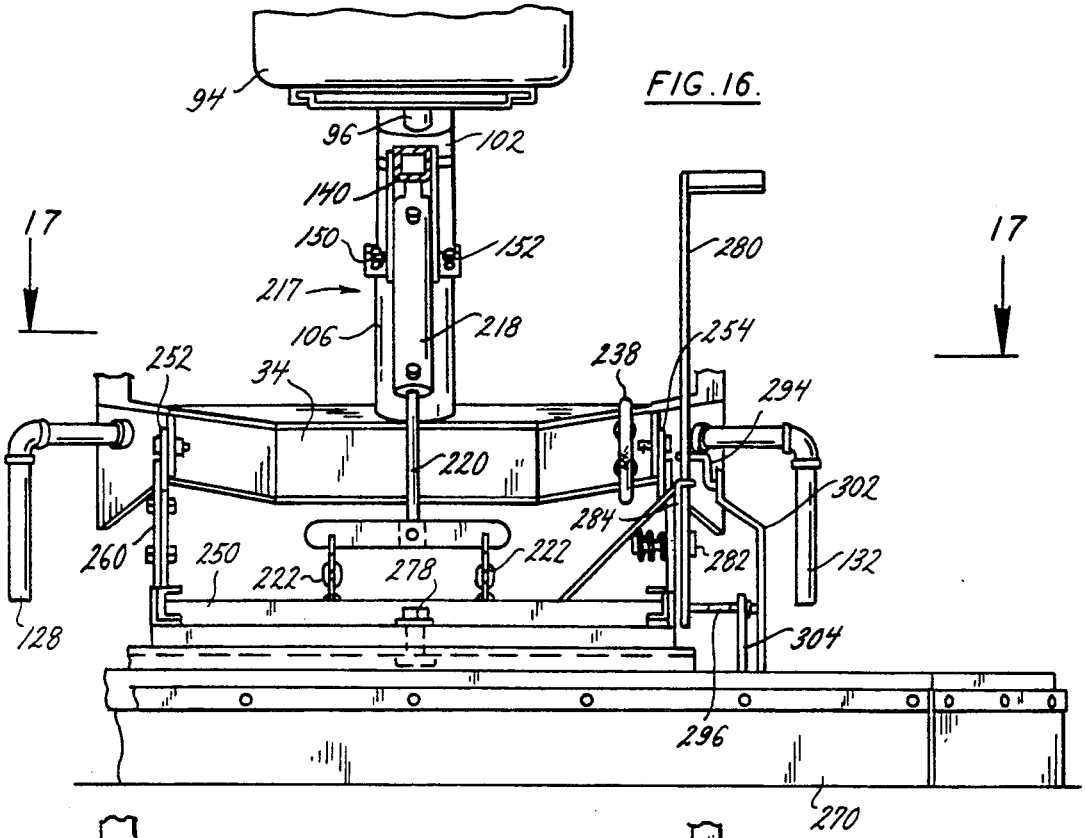
FIG. 16 is a segmented elevation view of the wiper blade assembly taken along the line 16—16 of FIG. 15.
Figure 17:
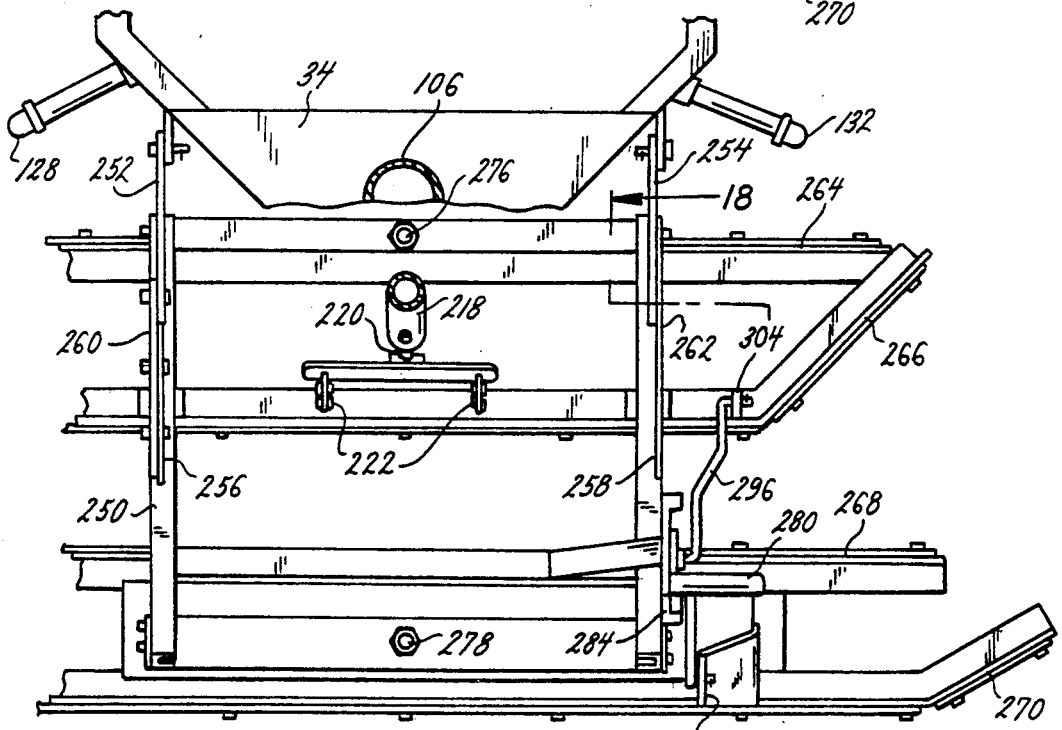
FIG. 17 is a segmented plan view of the wiper blade assembly taken along the line 17—17 of FIG. 16.

Suspended below the blade assembly frame 250 are two pairs of wiper blades 264, 266, 268, 270. The arrangement of the wiper blades of the two pairs, relative to each other, is best seen in FIGS. 21A through 21C. As seen in FIG. 21, the forward most of the pairs of wiper blades 264, 268 are substantially straight and extend laterally across the rearward end of the vehicle. The second or rearward most of the pairs of wiper blades 266, 270 each include forward turned portions at their opposite ends. This configuration of the wiper blades of each pair causes surface coating material that is spread along the road surface by the front wipers 264, 268, and spreads past the opposite ends of the front wipers, to be gathered in by the forward turned opposite ends of the second wipers 266, 270 and spread back toward the center of the second wipers. Each of the forward and rearward pair of wipers is constructed on an angle iron frame that is itself pivotally attached to the blade assembly frame 250. The pair of forward wiper blades 264, 266 are attached to and pivot relative to the frame 250 by the pivot connection 276 provided by a nut and bolt fastener. The rearward pair of wiper blades 268, 270 are pivotally connected to the frame 250 by the pivot connection 278 provided by a nut and bolt fastener between the pair of blades and the blade assembly frame 250. The two pivot connections 276, 278 enable the pairs of wiper blades to pivot from side to side about vertical axis extending through the two pivot connections.

A manually operable linkage assembly is connected between the two pairs of wiper blades to control their pivoting movement. The linkage assembly is best seen in FIG. 18, and is comprised of a manual lever 280 connected by a pivot connection 282 to a support bracket 284, that in turn is secured to the wiper assembly frame 250. A series of detents 286, 288, 290 are provided in an out-turned upper edge of the support bracket 284 to provide positive engagement between the manual lever 280 and the detents in three adjusted positions of the pairs of wiper blades. The pivot connection 282 between the manual lever 280 and the bracket 284 is a spring biased connection as is best seen in FIG. 19. This connection permits the operator of the vehicle to move the manual lever 280 away from the bracket 284 and against the bias of a spring 292 of the pivot connection 282, to pivot the manual lever about the pivot connection and engage the lever in a selected one of the three detent positions 286, 288, 290. The phantom lines in FIG. 19 show the manual lever 280 moved outward away from the bracket 284 against the bias of the pivot connector spring 292. Connected to the manual lever 280 on opposite sides of the pivot connection 282 are upper and lower linkage members 294, 296. The opposite ends of these two linkage members are pivotally connected to vertical arms 302, 304 that are securely connected to and extend vertically upward from the frames of the rearward and forward pairs of wiper blades respectively. As is best seen in FIG. 18, manipulation of the manual lever 280 forward or to the right in the drawing Figure, to engage the manual lever in the detent 286, will cause the two linkage members 294, 296 to pull the right hand ends of the pair of wiper blade assemblies toward each other to the relative positions of the wiper blades shown in FIG. 21C. In this position, the pairs of wiper blades will spread surface coating material to the right across the first wiper blade 264, and surface coating material that is spread around the far right end of the first pair of wiper blades will be gathered in by the second pair of wiper blades and spread to the left by the second pair of blades. Manipulation of the manual lever 280 rearward or to the left as viewed in FIG. 18 to engage the lever in the detent 290 will cause the linkage members 294, 296 to spread the right hand ends of the pairs of wiper blades away from each other to the relative positions shown in FIG. 21B. In this position of the pairs of wiper blades, the first pair of wiper blades will spread surface coating material to the left, and surface coating material that passes around the left hand side of the first pair of wiper blades will be gathered in by the second pair of wiper blades and spread to the right. By manipulating the manual lever 280 to the position shown in FIG. 18, with the lever engaging in the middle detent 288, the pair of linkage members 294, 296 will position the pairs of wiper blades parallel to each other as shown in FIG. 21A. Between the three relative positions of the pairs of wiper blades obtainable by the wiper blade assembly of the present invention and shown in FIGS. 21A-21C, the wiper blade assembly of the present invention may be employed to spread surface coating material over a wide variety of traffic surfaces having various curvatures and inclinations.

Figure 22:
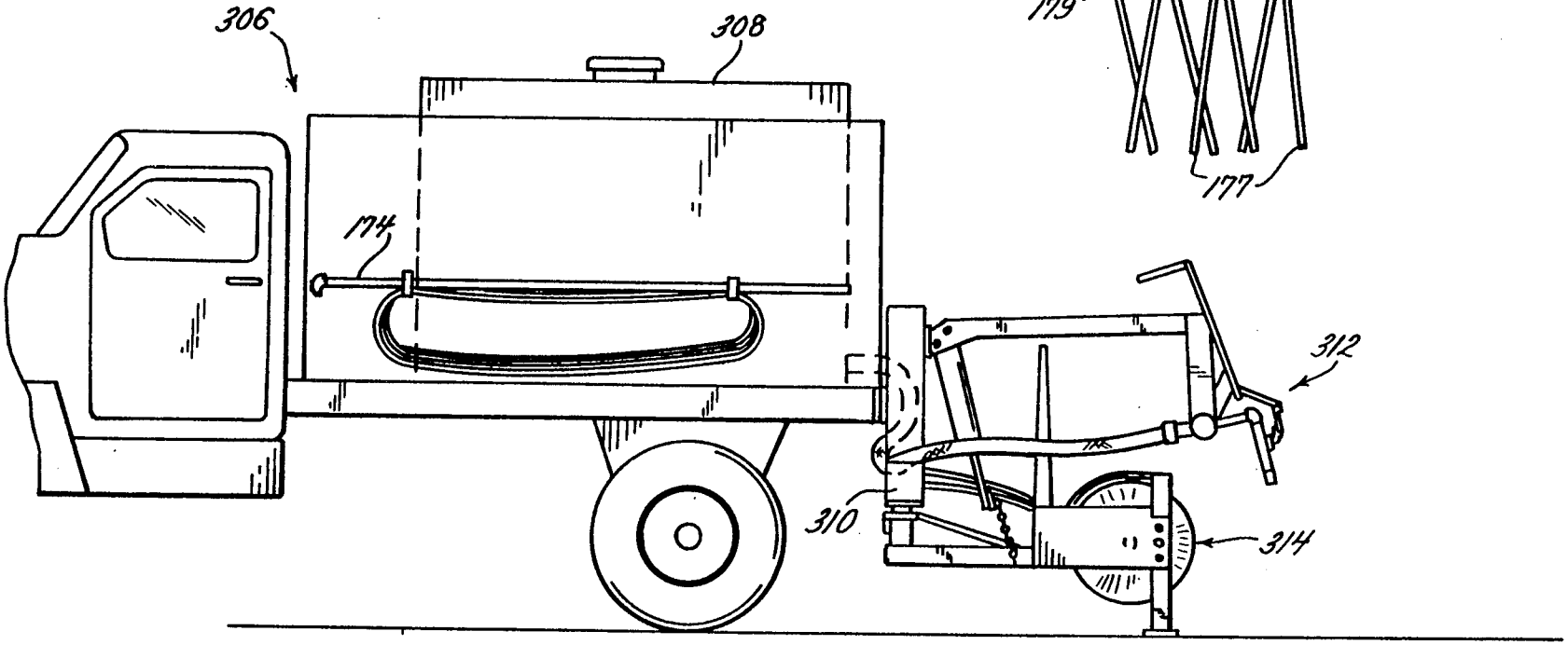
FIG. 22 is a segmented side elevation view showing the rotating brush assembly of the invention supported from the rearward end of a utility vehicle, that in turn supports the surface coating material reservoir on its bed.
Figure 15:
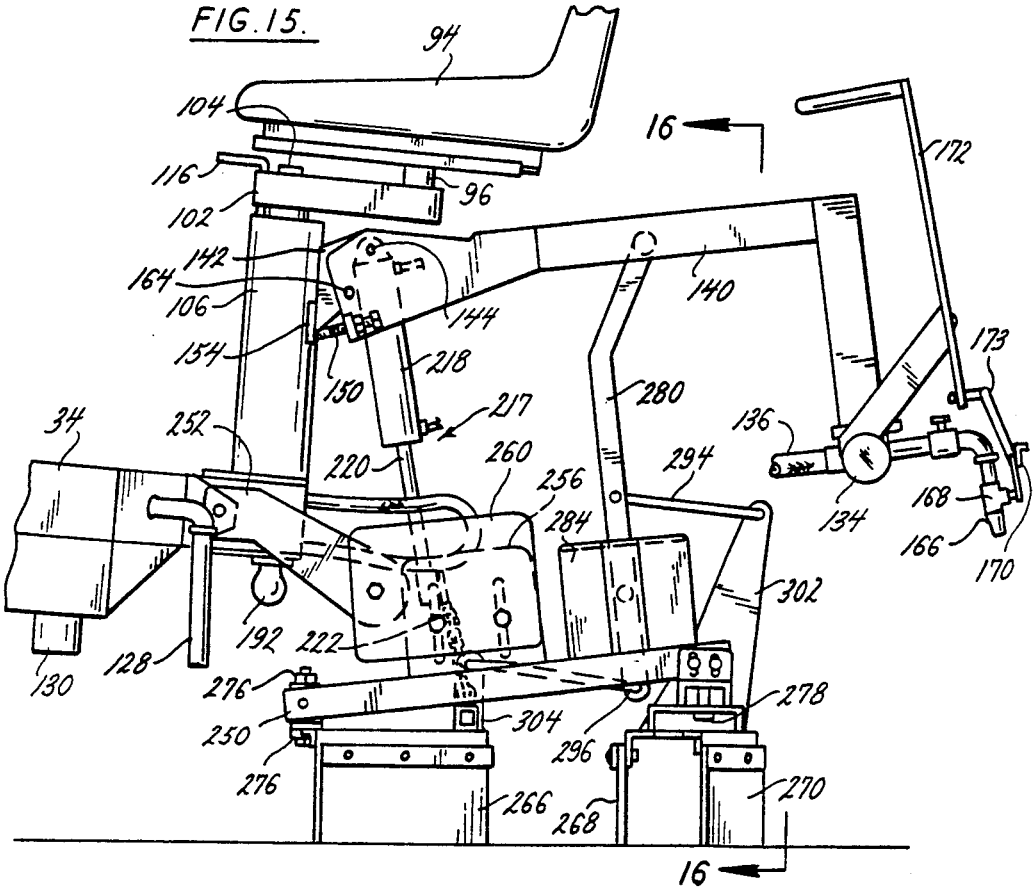
FIG. 15 is a segmented side elevation view of the pivoting connection between the wiper blade assembly and the vehicle frame.

Although the surface coating material applying and spreading apparatus of the present invention has been described as a self-contained vehicle, many of the novel features of the present invention may be incorporated into an existing vehicle without departing from the scope of the invention. FIG. 22 of the drawings shows a flat bed truck 306 supporting a reservoir of surface coating material 308, and also having a frame 310 attached at its rearward end that supports many of the features of the present invention. The frame 310 is shown supporting the sprayer bar assembly 312 and the rotating brush assembly 314 of the preferred embodiment of the invention described above. It should be apparent that the rotating brush assembly 314 of this embodiment may be disassembled from the frame 310 and replaced with the previously described wiper blade assembly.

While the present invention has been described by reference to specific embodiments, it should be understood that modifications, and variations of the invention may be constructed without departing from the scope of the invention defined in the following claims.

I claim:

1. A vehicle for applying and spreading surface coating material on roadway surfaces, the vehicle comprising:

a vehicle frame;

a surface coating material reservoir supported on the vehicle frame;

a sprayer bar assembly supported on the vehicle frame for pivoting movement relative thereto, the sprayer bar assembly having a plurality of spray nozzles spatially arranged across the sprayer bar;

a surface coating material pump supported on the vehicle frame, the pump being operatively connected between the reservoir and the sprayer bar assembly;

a valve operatively connected between the pump and the sprayer bar assembly for selective communication of the pump with the sprayer bar assembly to supply surface coating material from the reservoir to the sprayer bar assembly on selective operation of the valve; and, a rotating brush assembly is pivotally supported on the vehicle frame and is adapted to be raised and lowered relative to the frame, the brush assembly is arranged to engage the sprayer bar assembly and raise and lower the sprayer bar assembly as the brush assembly is raised and lowered.

2. The vehicle of claim 1, wherein:

the sprayer bar assembly is adapted to be locked in its raised position and remain raised as the brush assembly is raised and lowered.

3. The vehicle of claim 1, wherein:

a wiper blade assembly is adapted to be pivotally supported on the vehicle frame in place of the rotating brush assembly, and the blade assembly is adapted to be raised and lowered relative to the frame.

4. The vehicle of claim 3, wherein:

the wiper blade assembly includes two pairs of wiper blades, and each pair of wiper blades is selectively pivotable about a vertical axis.

5. A vehicle for applying and spreading surface coating material on roadway surfaces, the vehicle comprising:

a vehicle frame;

a rotating brush assembly pivotally supported on the vehicle frame and adapted to be raised and lowered relative to the vehicle frame;

a motor means connected between the brush assembly and the frame, the motor means being selectively actuated to raise and lower the brush assembly relative to the frame;

a sprayer bar assembly pivotally supported on the frame;

the brush assembly and sprayer bar assembly being arranged so that the brush assembly engages the sprayer bar assembly and raises and lowers the sprayer bar assembly as the brush assembly is raised and lowered.

6. The vehicle of claim 5, wherein:

the sprayer bar assembly is adapted to be locked in its raised position and remain raised as the brush assembly is raised and lowered.

7. The vehicle of claim 5, wherein:

a second motor means is connected between the brush assembly and the frame, the second motor means being selectively actuated to pivot the brush assembly from side to side about a vertical axis.

8. The vehicle of claim 5, wherein:

a wiper blade assembly is adapted to be pivotally supported on the vehicle frame in place of the rotating brush assembly, the blade assembly being adapted to be raised and lowered relative to the frame.

9. The vehicle of claim 8, wherein:

the wiper bade assembly includes two pairs of wiper blades, each pair of blades being selectively pivotable about a vertical axis.

10. The vehicle of claim 9, wherein;

the two pairs of wiper blades are selectively pivotable in the same or opposite directions.

11. A vehicle for applying and spreading surface coating material on roadway surfaces, the vehicle comprising:

a vehicle frame;

a rotating brush assembly pivotally supported on the vehicle frame and adapted to be raised and lowered about a horizontal axis, and pivoted from side to side about a vertical axis relative to the vehicle frame;

a first motor means connected between the brush assembly and the frame, the motor means being selectively actuated to raise and lower the brush assembly relative to the frame; and a second motor means connected between the brush assembly and the frame, the second motor means being selectively actuated to pivot the brush assembly, from side to side relative to the frame.

12. The vehicle of claim 11, wherein:

the brush assembly includes a third motor means connected to the rotating brush, the third motor means being selectively actuated to rotate the brush in either a first or a second direction.

13. A vehicle for applying and spreading surface coating material on roadway surfaces, the vehicle comprising:

a vehicle frame;

a surface coating material reservoir supported on the vehicle frame;

a sprayer bar assembly supported on the vehicle frame for pivoting movement relative thereto, the sprayer bar assembly having a plurality of spray nozzles spatially arranged across the sprayer bar;

a surface coating material pump supported on the vehicle frame, the pump being operatively connected between the reservoir and the sprayer bar assembly;

a valve operatively connected between the pump and the sprayer bar assembly for selective communication of the pump with the sprayer bar assembly to supply surface coating material from the reservoir to the sprayer bar assembly on selective operation of the valve; and, a wiper blade assembly pivotally supported on the vehicle frame and adapted to be raised and lowered relative to the frame, the wiper blade assembly being arranged to engage the sprayer bar assembly and raise and lower the sprayer bar assembly as the wiper blade assembly is raised and lowered.

14. The vehicle of claim 13, wherein:

the sprayer bar assembly is adapted to be locked in its raised position and remain raised as the wiper blade assembly is raised and lowered.

15. The vehicle of claim 13, wherein:

a rotating brush assembly is adapted to be pivotally supported on the vehicle frame in place of the wiper blade assembly, and the brush assembly is adapted to be raised and lowered relative to the frame.

16. The vehicle of claim 13, wherein:

the wiper blade assembly includes two pairs of wiper blades, and each pair of wiper blades is selectively pivotable about a vertical axis.

* * * * *